US008648268B2

(12) United States Patent
Ashcroft

(10) Patent No.: US 8,648,268 B2
(45) Date of Patent: Feb. 11, 2014

(54) ELECTRO-MECHANICAL MICROWAVE SWITCH

(75) Inventor: Mark Ashcroft, Worstead (GB)

(73) Assignee: Fluke Corporation, Everett, WA (US)

( * ) Notice: Subject to any disclaimer, the term of this patent is extended or adjusted under 35 U.S.C. 154(b) by 917 days.

(21) Appl. No.: 12/651,874

(22) Filed: Jan. 4, 2010

(65) Prior Publication Data

US 2011/0162943 A1 Jul. 7, 2011

(51) Int. Cl.
*H01H 19/00* (2006.01)
*H01H 19/11* (2006.01)

(52) U.S. Cl.
USPC ..... 200/11 R

(58) Field of Classification Search
USPC ..... 200/11 R
See application file for complete search history.

(56) References Cited

U.S. PATENT DOCUMENTS

| | | | | |
|---|---|---|---|---|
| 4,839,619 | A | 6/1989 | Mutton | |
| 4,967,174 | A | 10/1990 | Yee et al. | |
| 7,432,787 | B2 * | 10/2008 | Muench et al. | 335/76 |
| 2008/0110740 | A1 * | 5/2008 | Rauh | 200/5 R |
| 2009/0277762 | A1 | 11/2009 | Nakatsuka et al. | |

OTHER PUBLICATIONS

European Search Report dated Nov. 20, 2013, in EP Application No. EP 10194778.6, filed Dec. 13, 2010, 3 pages.

* cited by examiner

*Primary Examiner* — Renee S Luebke
*Assistant Examiner* — Lheiren Mae Caroc
(74) *Attorney, Agent, or Firm* — Christensen O'Connor Johnson Kindness PLLC

(57) ABSTRACT

A switch for selectively routing electrical signals, particularly microwave signals, in a printed circuit board includes a rotatable contact that is connected to a shaft. A first motor is configured to rotate the shaft and a second motor is configured to axially move the shaft to lift the contact from the printed circuit board. A position controller produces driving signals that are received by the first and second motors to lift the contact from the printed circuit board, rotate the contact to a desired position and lower the contact to the circuit board.

11 Claims, 7 Drawing Sheets

ELECTRO-MECHANICAL MICROWAVE SWITCH

BACKGROUND

Most electronic circuits include one or more switching mechanisms to selectively route electrical signals to different components in the circuit. Such switching mechanisms are most often solid state, transistor-based switches, electro-mechanical devices, such as relays, or purely mechanical switches that are moved by hand. While such switches work well for relatively low frequency signals, more sophisticated mechanisms are required as the frequency of the electrical signals to be switched extends into the Gigahertz range.

When switching high frequency signals such as microwave signals, the switch must be carefully designed to avoid any unnecessary reflections of the signals and losses in the signal path. For example, commonly used microwave switches typically have a number of solenoid driven contact pads that are mounted on the ends of plastic rods. The contact pads are selectively lifted from, or placed onto, a circuit board in order to break or make an electrical connection. Each contact pad is a precision made machined part that springs when it is flexed so that the contact pad is somewhat self-cleaning. The precision with which the parts of such a switch design must be made makes this type of switch design very expensive to manufacture. Furthermore, it is very difficult to balance the cleaning action of the contact (through micro-machining, hand adjustments or lubricants) against contact wear. Long life of the contact (more than ten million operations) or guaranteed first time operation are hard to achieve and are often not met. Finally, such switches can have relatively low isolation due to the capacitive connection created when the contact is lifted a short distance from the circuit board.

Given these problems and others, there is a need for an improved electrical switching system that can be used with microwave or other signals.

SUMMARY

The technology described herein relates to electronic switches and in particular to switches that can switch high frequency microwave signals. In one embodiment, a switch includes a rotatable contact that is selectively aligned with one of a number of conductors such as a microstrip line. The rotatable contact is moved with a pair of motors that programmably lift the contact from the printed circuit board, rotate the contact to a desired position and lower the contact in the desired position. The motors can also move the contact once it is in place on the circuit board to clean the contact.

In one embodiment, the contact is secured to a rod. The rod is rotated about its longitudinal axis by a first stepper motor and is moved back and forth along its length by a second stepper motor. Movement by the second stepper motor allows the contact to be placed on the printed circuit board with an adjustable pressure. The pressure is adjustable to compensate for life of the contact, wear, machining tolerances or to ensure operation.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed technology will become more readily appreciated as the same become better understood by reference to the following detailed description, when taken in conjunction with the accompanying drawings, wherein.

DETAILED DESCRIPTION

Figure 1:
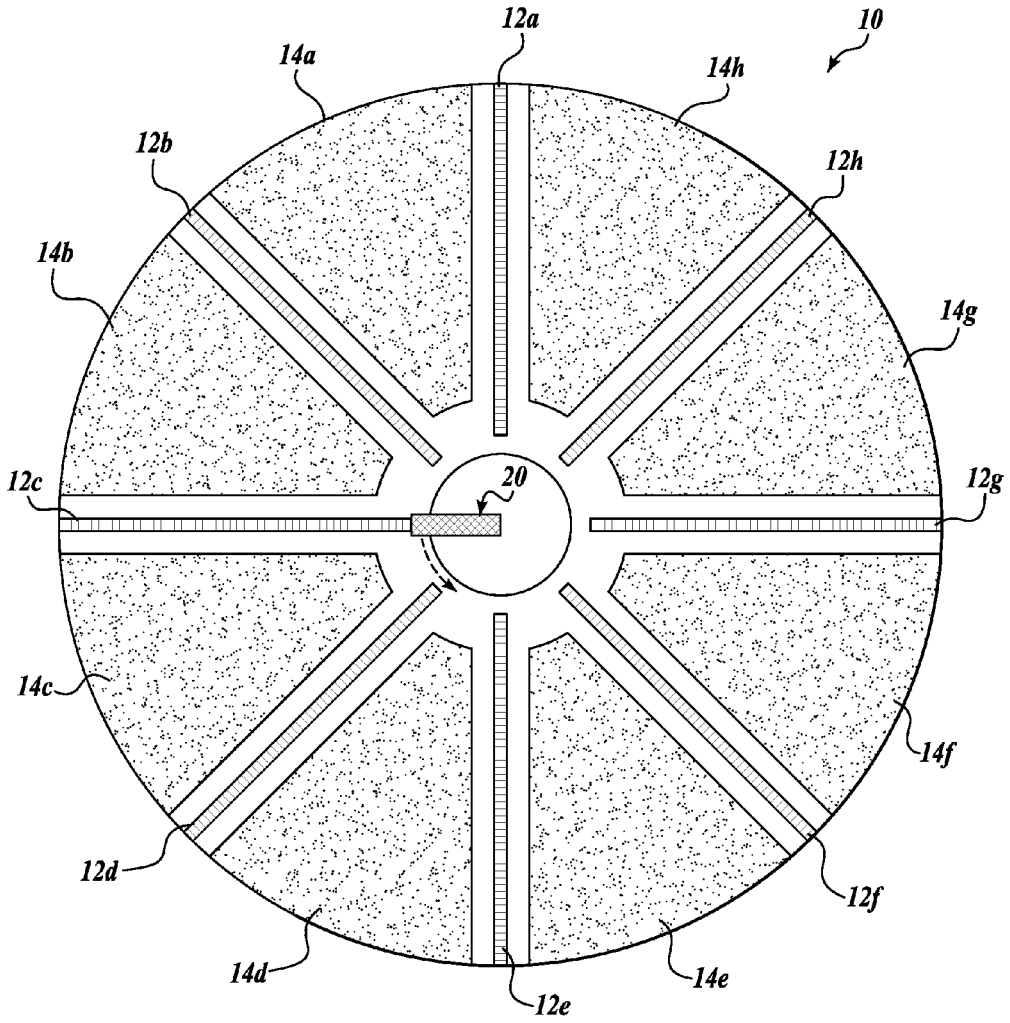
FIG. 1 illustrates a portion of a printed circuit board with a number of microstrip lines and a rotatable switch contact in accordance with one embodiment of the disclosed technology.

As indicated above, the technology disclosed herein relates to a switch that can be used to route electrical signals and in particular high frequency electrical signals from an input to an output. FIG. 1 illustrates a portion of a metal backed printed circuit board 10 having a number of microstrip lines 12*a*-12*h* secured thereon. As will be understood by those skilled in microwave engineering, grounding areas 14*a*-14*h* are positioned between the microstrip lines 12*a*-12*h* such that microwave signals travel in the space between the microstrip lines and the grounding areas. Although the printed circuit board 10 has a circular shape, it will be appreciated that the printed circuit board may be included as part of a larger circuit board with other patterns of microstrip lines or traces secured thereon.

In the embodiment shown, the microstrip lines 12*a*-12*h* extend radially outward from a central point on the metal backed printed circuit board 10. A rotatable contact 20 is positioned such that one end of the contact selectively engages one of the microstrip lines 12*a*-12*g* and another end of the contact 20 selectively engages a RF connector (not shown). By changing the angular orientation of the contact 20, a conductive path is selectively formed between one of the microstrip lines and the RF connector.

Figure 2A:
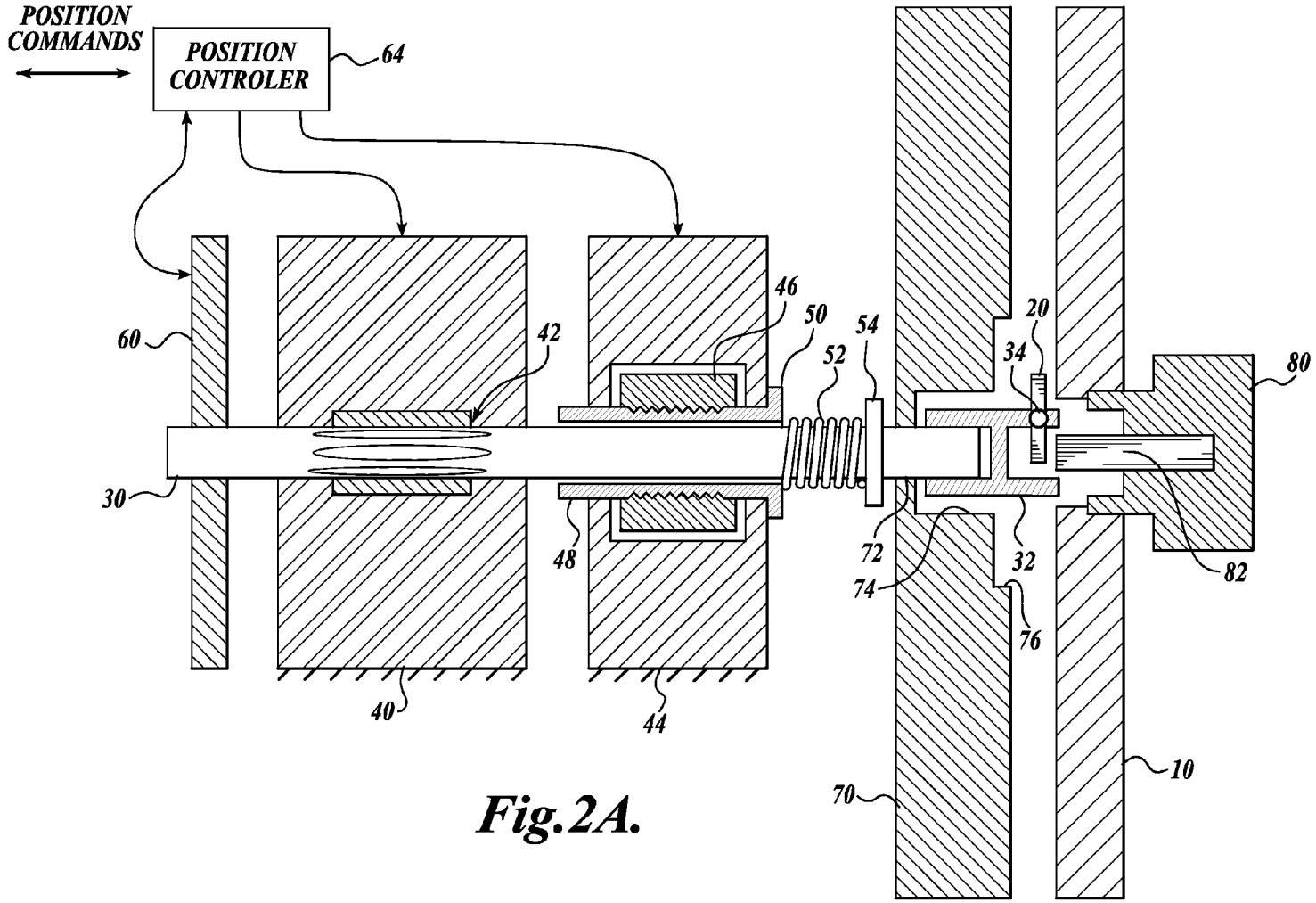
FIG. 2A illustrates a switch constructed in accordance with one embodiment of the disclosed technology.

FIG. 2A illustrates one embodiment of an electro-mechanical microwave multiplexer or switch in accordance with the disclosed technology. The switch has a shaft 30 that supports and moves the rotatable contact 20. A metal contact carrier 32 is secured to one end of the shaft 30. The contact carrier 32 has a first hollow end with a central opening therein into which an end of the shaft 30 is fitted. In one embodiment, the rotatable contact 20 comprises a strip of conductive metal that fits within an insulating bush 34. The insulating bush 34 is secured within a side wall of the contact carrier 32 such that a portion of the contact extends radially outwards from the contact carrier 32. The insulting bush 34 allows the ends of the contact 20 to engage and disengage from a micro strip and a pin on an RF connector but prevents the contact from moving radially inwards or outwards.

Figure 2B:
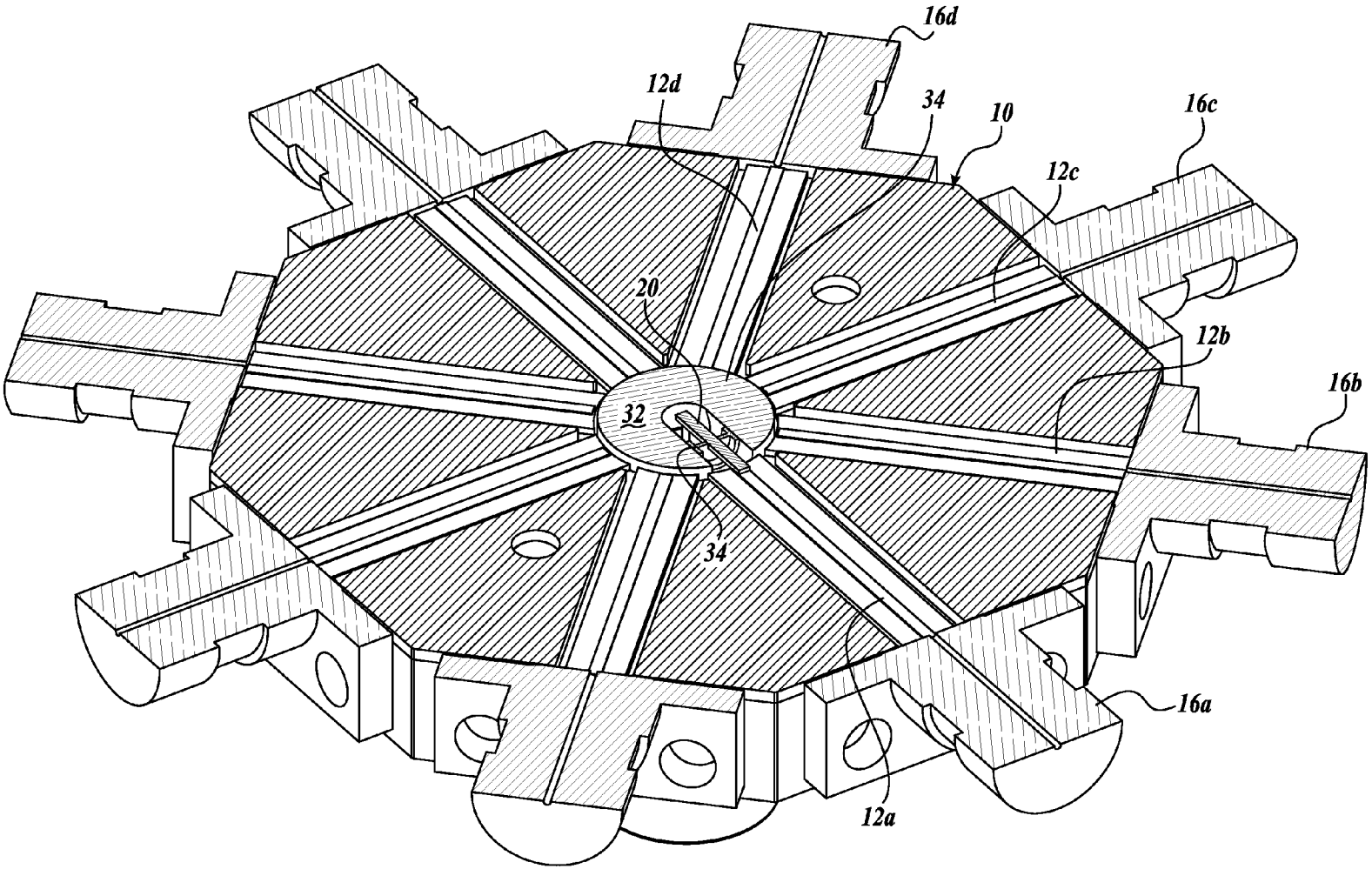
FIG. 2B illustrates an insulating bush within a tube that supports a coaxial rotatable contact within a contact carrier in accordance with an embodiment of the disclosed technology.

A more detailed view of an embodiment of the insulating bush 34 and the contact carrier 32 is shown in FIG. 2B. In this cross-sectional view of the switch, the printed circuit board 10 is octagonally shaped around its outer edge so that a number RF connectors 16*a*, 16*b* etc can be mounted to the switch and connected to a corresponding one of the microstrip lines 12*a*-12*b* etc. The contact 20 is secured within a hole in an inner wall of the bush 34 such that the ends of the contact are free to flex. In one embodiment, the contact 20 is formed of a small rectangular bar of conductive metal that is optimized within the surrounding tube for microwave integrity and match and does not have to be designed to be self cleaning. The bush 34 is seated within a radial hole in a side wall the contact carrier 32 such that one end of the contact 20 extends radially outwards from the contact carrier and another end of the contact extends radially inward to the hollow opening within the contact carrier.

Returning now to FIG. 2A, a pair of stepper motors 40 and 44 are driven with signals from a position controller 64 to rotate the shaft 30 and/or to raise and lower the contact 20 from the printed circuit board. Both of the stepper motors are held in a fixed relation to with respect the printed circuit board 10. In one embodiment, the stepper motors 40 and 44 are secured to a metal top screen printed circuit board 70 that fits over the microstrip lines on the printed circuit board 10 and is secured to the printed circuit board 10.

In the embodiment shown, the stepper motor 40 is a splined drive stepper motor that has gear teeth that engage a number of longitudinal splines 42 on the exterior of the shaft 30. Driving the stepper motor 40 with commands from the position controller 64 causes the shaft 30 to rotate around its longitudinal axis and therefor changes the angular orientation of the contact 20. The stepper motor may have 200 or more steps with 1.8 degrees of resolution or less. A greater number of steps could be used for a finer resolution and potentially a longer time to move the contact. Similarly, fewer steps could be used to decrease the move time but with less resolution.

The stepper motor 44 is a linear drive that rotates a threaded member 46 such as a nut. The nut has threads that engage cooperating threads on an exterior of a sleeve 48 that surrounds the shaft 30. One end of the sleeve 48 includes flange 50. A spring 52 is secured at one end to the flange 50 and at another end to a radial flange 54 on the shaft 30. Driving the stepper motor 44 with commands from the position controller 64 causes the nut 46 to move the sleeve 48 towards or away from the contact carrier 32.

Figure 2C:
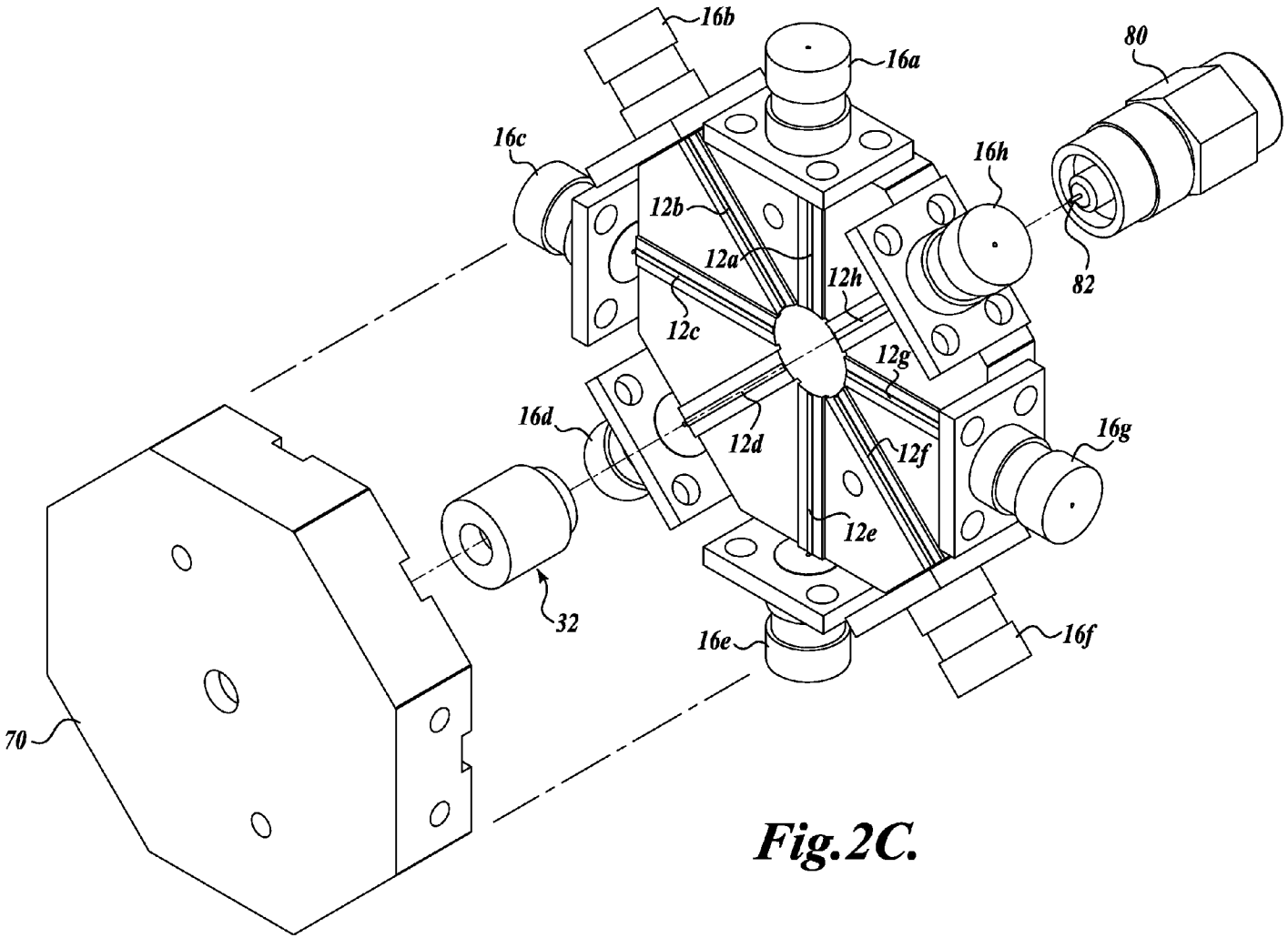
FIG. 2C illustrates an exploded view of a switch in accordance with an embodiment of the disclosed technology.
Figure 2D:
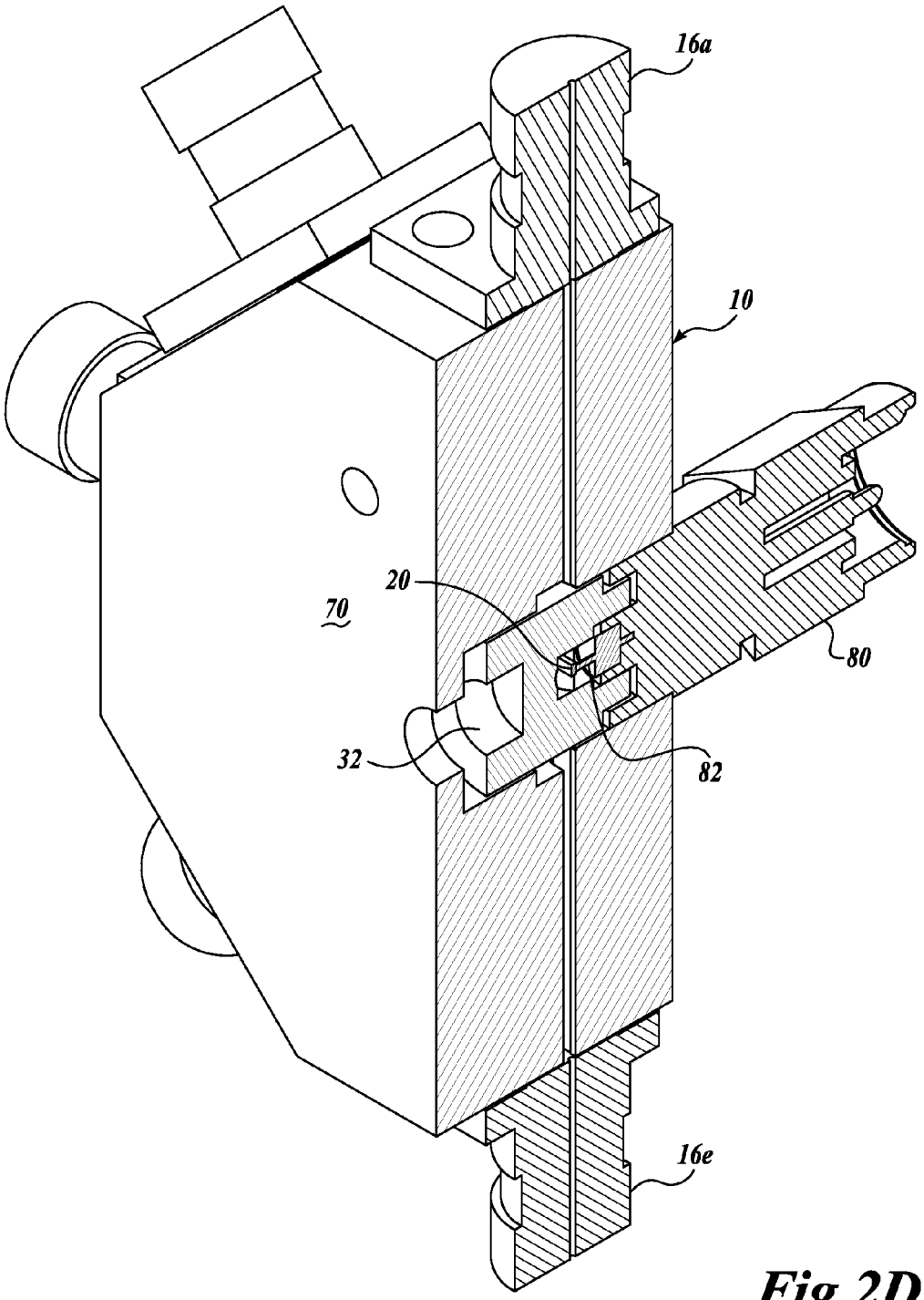
FIG. 2D illustrates a signal path through a rotatable switch contact in accordance with an embodiment of the disclosed technology.

When the stepper motor 44 moves the sleeve 48 sufficiently far towards the contact carrier 32, one end of the contact 20 is pressed onto the printed circuit board 10 to engage a microstrip line. The other end of the contact 20 engages a center conducting pin 82 of an RF connector 80 as is best shown in FIG. 2D. In one embodiment, the RF connector 80 is a 2.92 type connector that is fixed to the circuit board 10. However, other types of suitable microwave connectors could be used. Alternatively, the pin 82 to which the contact 20 is engaged may be connected to a microstrip line that runs on another side of the printed circuit board.

The force of compression of the connector 20 onto the printed circuit board 10 and center conducting pin 82 is controlled the amount of compression of the spring 52.

When the stepper motor 44 moves the sleeve 48 away from the contact carrier 32, the spring 52 lengthens to the point where further movement of the sleeve away from the contact carrier 32 lifts the contact 20 from the circuit board. Although the disclosed embodiment uses a wound spring 52 to adjust the pressure of the contact 20 on the printed circuit board, it will be appreciated that other mechanisms such leaf springs, magnetic springs or gas springs could be used to vary the pressure with which the contact is engaged with a microstrip line.

An encoder circuit board 60 has conventional circuitry thereon that detects the rotational (angular) and axial position of the shaft 30. The circuitry on the encoder circuit board 60 provides position signals that describe the rotational and axial positions of the shaft 30 to the position controller 64. The position controller 64 may include a microcontroller or other programmable circuit that executes a sequence of programmed instructions stored on a computer readable memory (IC, flash memory, CD, DVD etc). The programmed instructions cause the position controller 64 to read the position signals and produce appropriate driving signals to move one or both of the stepper motors 40 and 44 in order to position the contact 20 in the desired location. The position controller 64 may receive signals from a number of devices such as another component in a circuit or from a remote computer, microcontroller or from a manually actuated switch to select the angular desired orientation of the contact 20. In one embodiment, the position controller 64 is configured to communicate with other computers or other circuitry via a computer communication link (I2C, SPI, USB, Firewire, WI-FI, LAN, WAN etc.) in order to allow the position controller 64 to be controlled remotely or to perform such tasks as a remote reset or to update firmware etc.

Figure 3:
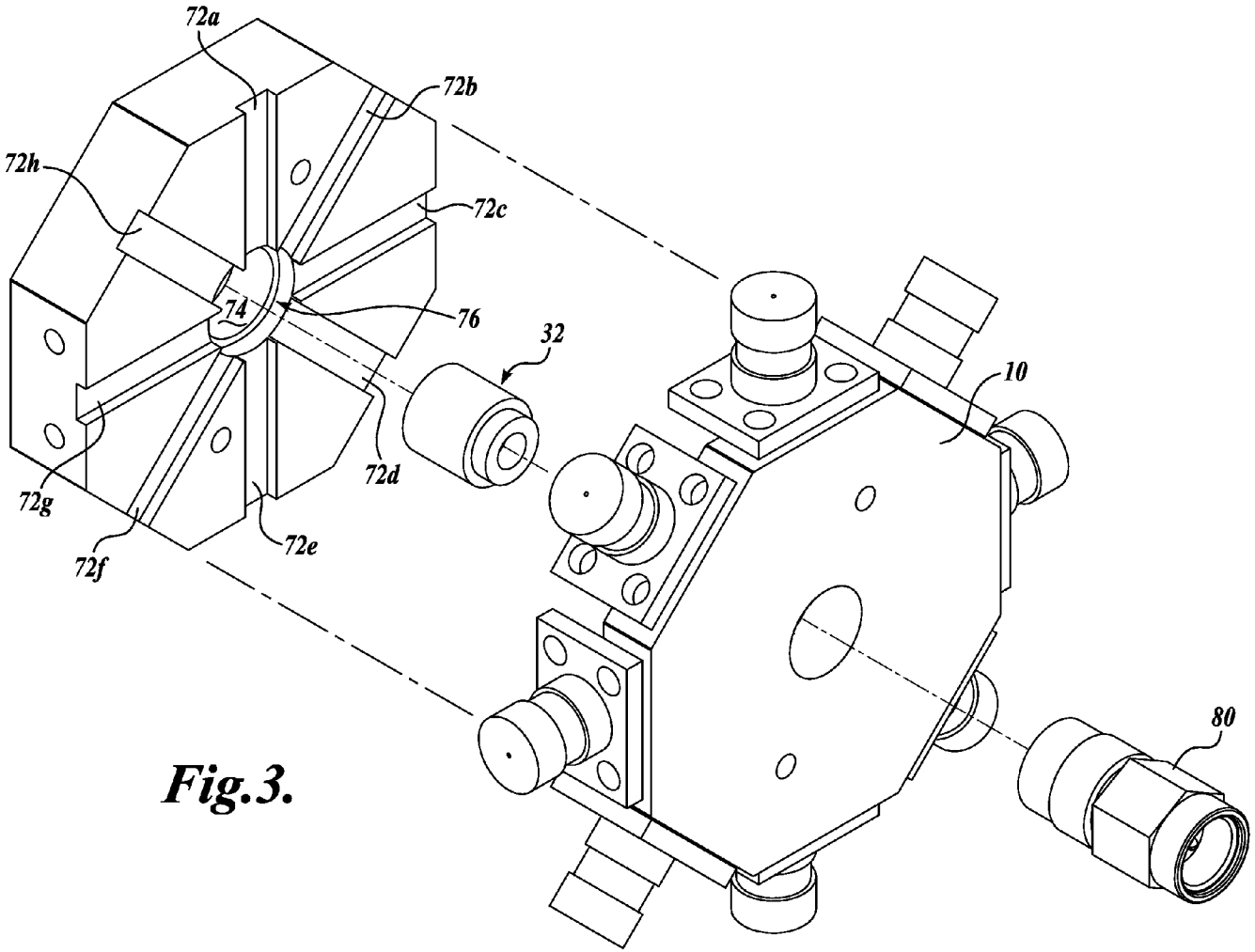
FIG. 3 illustrates a portion of a metal backed screen that fits over a printed circuit board and accommodates a rotatable contact used in the switch shown in FIG. 2A.

Covering the printed circuit board 10 is a metal top screen circuit board 70 having slots therein that overlay the microstrip lines. As is best shown in FIGS. 2C and 3, the metal top screen circuit board 70 has a number of slots 72*a*-72*h* that overlay the microstrip lines 12*a*-12*h* on the printed circuit board 10. The metal top screen has a hole 72 through which the shaft 30 is fitted. When assembled, the metal top screen 70 is positioned flush against the printed circuit board 10. The metal top screen includes a first recess 74 that is deep enough to receive the contact carrier 32 when the contact 20 is lifted from the printed circuit board 10. A second recess 76 has a depth and diameter that allows the contact 20 to be lifted from the printed circuit board 10 and rotated by the shaft 30.

During operation, the stepper motors 40,44 operate together to rotate and/or lift the contact 20. If both stepper motors 40, 44 move by the same amount, the contact 20 is rotated but is not lifted up or down on the printed circuit board. If the stepper motor 44 moves the nut 46 relative to the shaft 30, then the shaft will be pulled back from the circuit board 10 or advanced toward the circuit board.

In one embodiment, the position controller 64 supplies signals to the stepper motor 44 to lift the contact 20 from the printed circuit board. Next, the position controller supplies signals to the stepper motors 40 and 44 to rotate the contact 20 to align with a desired microstrip. Once the contact 20 is aligned with the desired microstrip line, signals are applied from the position controller 64 to the stepper motor 44 to engage the contact 20 to the desired microstrip line and the RF connector. The position controller 64 can also produce signals, such as analog drive signals, that cause the stepper motor 40 to move the contact back and forth while the contact is engaged with a microstrip line and the RF connector. This creates a scraping action on the contact that cleans the contact and improves the conductivity of the switch. Such cleaning cycles can be performed on a periodic basis or upon some other predetermined circuit condition such as a reboot, reset or upon operator command.

In one embodiment, the DC resistance of the switch is detected with an appropriate testing circuit that may be built into the position controller 64 or made with a separate circuit components. Depending on the DC resistance detected, the position controller 64 can initiate a scraping cycle on the rotatable contact 20 or may increase or decrease the pressure with which the contact is urged against the microstrip line and the center conductor 82 of the RF connector 80.

Figure 4:
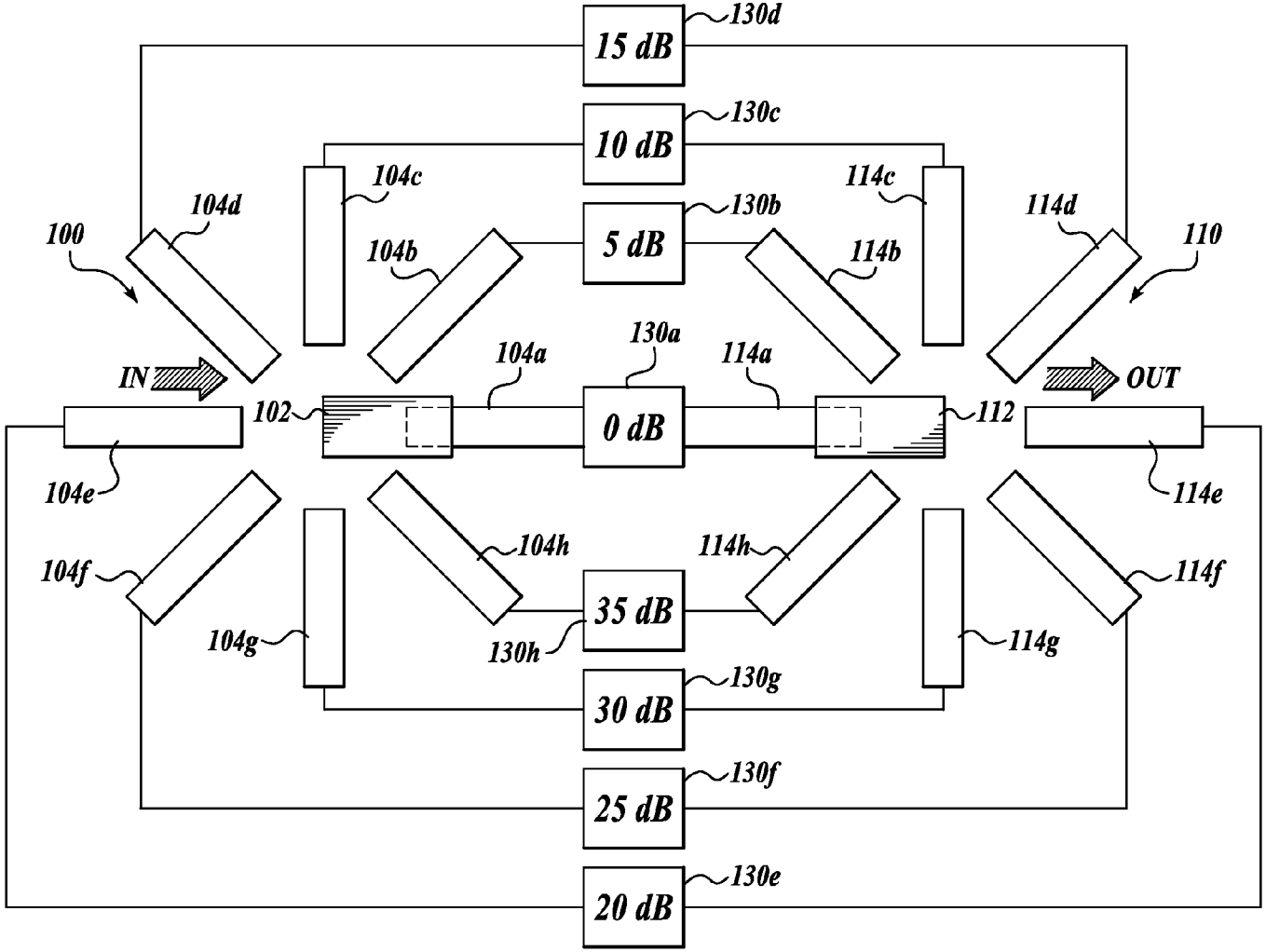
FIG. 4 illustrates a pair of switches arranged to form a programmable attenuator in accordance with an embodiment of the disclosed technology.

FIG. 4 illustrates the use of a pair of switches constructed in accordance with the disclosed technology and are arranged to create a programmable attenuator. In this configuration, a first switch 100 includes a rotatable contact 102 that connects an RF connector (not shown) that operates as an input at the center of the switch to one of a number of microstrip lines 104*a*-104*h*. A second switch 110 includes a rotatable contact 112 that connects an RF connector that operates as an output (not shown) at the center of the switch to one of a number of microstrip lines 114*a*-114*h*. Each of the microstrip lines 104*a*-104*h* and 114*a*-114*h* are connected together with a different attenuation circuit 130*a*-130*h*. For example, each attenuation circuit may be a Pi or T-type attenuator circuit. By controlling the angular position of the contacts 102 and 112, a variable attenuation can be created between the input and output RF connectors. Because the switches 100 and 110 are formed on a single printed circuit board, the need for cables in the attenuator is eliminated and the values of the attenuation circuits 130*a*-130*h* can be carefully controlled to provide accurate operation.

As will be appreciated, the switch/multiplexer of the disclosed technology provides several advantages over conventional solenoid operated microwave switches/multiplexers. First, the disclosed switch can be directly mounted to a printed circuit board. In addition, the rotatable contact is placed nearly in-line with a selected microstrip line thereby reducing insertion losses and impedance mismatches. Because of the lift and place movement caused by control of the stepper motors, wear on the contact is reduced and the life of the contact is increased. In addition, by monitoring signals from the circuitry on the board encoder circuit 60, alignment of the contact 20 and the microstrip lines can be made without labor intensive manual adjustments. Furthermore, contact wear over time can also be accounted for by the position controller 64. For example, the position controller 64 can be programmed to keep track of the number of times the switch is moved and adjustments made to the contact pressure made to compensate for contact wear. In addition, the switch reduces the number of precision made parts. Finally, the disclosed switch improves isolation because the contact is moved relatively far away from the non-connected microstrip lines and screening metal replaces its position.

While illustrative embodiments have been illustrated and described, it will be appreciated that various changes can be made therein without departing from the scope of the invention. For example, instead of using a threaded linear stepper motor to lift and lower the contact, it will be appreciated that other mechanisms such a camming mechanism could be used to lift and lower the contact. In another alternative, the stepper motors could be replaced with equivalently operating servo motors. It is therefore intended that the scope of the invention be determined from the following claims and equivalents thereof.

The embodiments of the invention in which an exclusive property or privilege is claimed are defined as follows:

1. A switch for selectively connecting one of a number of microwave microstrip lines on a printed circuit board to an RF connector, comprising:

a rotatable contact having one end configured to be placed in electrical contact with a selected microstrip line and another end configured to be in electrical contact with the RF connector;

a shaft coupled to the contact;

means for rotating the shaft in order to rotate the contact;

means for axially moving the shaft to lift and lower the contact from a selected microstrip line and the RF connector; and a controller that is configured to produce driving signals that are received by the means for rotating the shaft and the means for axially moving the shaft such that the contact is selectively lifted from a printed circuit board, rotated to align with a selected microstrip line and lowered onto the selected microstrip line, wherein the controller is configured to produce driving signals that are received by the means for rotating the shaft when the contact is engaged with a microstrip line to clean the rotatable contact.

2. The switch of claim 1, further comprising:

an encoder circuit that is configured to produce signals indicative of the angular orientation of the shaft and the axial position of the shaft.

3. The switch of claim 1, further comprising:

a spring configured to control a pressure with which the rotatable contact is engaged with a microstrip line on the printed circuit board.

4. The switch of claim 1, wherein the driving signals to rotate the shaft for cleaning the contact are analog driving signals.

5. A switch configured to selectively route signals within a printed circuit board, comprising:

a first electrical contact;

a shaft having a rotatable contact secured thereto;

a number of electrical conductors that extend outward on the printed circuit board from the first electrical contact;

a first motor configured to rotate the shaft in order to align the rotatable contact with one of the electrical conductors;

a second motor configured to move the shaft such that the rotatable contact is lifted from an electrical conductor or lowered onto an electrical conductor; and a controller configured to drive the first and second motors such that the rotatable contact is lifted from one of the electrical conductors, rotated to align with another of the electrical conductors and lowered onto the other of the electrical conductors and the first electrical contact, wherein the second motor is configured to move a sleeve toward or away from the printed circuit board, and wherein a spring is secured to the sleeve at a first end and to the shaft at a second end such that movement of the sleeve adjusts a pressure with which the contact engages a microstrip.

6. The switch of claim 5, wherein the spring is configured to adjust a force with which the rotatable contact is lowered on the other of the electrical conductors.

7. A switch for selectively routing electrical signals in a printed circuit board, comprising:

a shaft;

a contact coupled to the shaft;

a first motor configured to selectively rotate the shaft; and a second motor configured to axially raise and lower the shaft to thereby raise and lower the contact with respect to a printed circuit board, wherein the first and second motors are configured to receive driving signals from a position controller to raise the contact from the printed circuit board, rotate the contact to a new position on the printed circuit board, and lower the contact onto the printed circuit board in the new position, and wherein the contact is secured within a sidewall of a contact carrier that is coupled to the shaft, wherein the contact has a first end extending radially outward from the contact carrier and a second end extending radially inward into a recess within the contact carrier.

8. The switch of claim 7, wherein the contact has a first end that is configured to be selectively placed on a microstrip line on the printed circuit board and a second end that is configured to be electrically connected to an RF connector.

9. The switch of claim 8, wherein the second end of the contact is configured to selectively engage the RF connector.

10. The switch of claim 7, wherein the second motor is configured to move a sleeve toward or away from the printed circuit board, and wherein a spring is secured to the sleeve at a first end and to the shaft at a second end such that movement of the sleeve adjusts a pressure with which the contact engages a microstrip.

11. The switch of claim 7, further comprising:

an encoder circuit that is configured to produce signals indicative of the angular orientation of the shaft and the axial position of the shaft.

* * * * *